US007798875B1

(12) United States Patent
Angel et al.

(10) Patent No.: US 7,798,875 B1
(45) Date of Patent: Sep. 21, 2010

(54) HELICAL MARINE STRUT

(75) Inventors: Bruce A. Angel, New Bern, NC (US); Glenn Lyle Spain, New Bern, NC (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/875,208

(22) Filed: Oct. 19, 2007

Related U.S. Application Data

(60) Provisional application No. 60/862,267, filed on Oct. 20, 2006.

(51) Int. Cl.
*B63H 5/10* (2006.01)

(52) U.S. Cl. ..... 440/82

(58) Field of Classification Search ..... 440/82
See application file for complete search history.

(56) References Cited

U.S. PATENT DOCUMENTS 1,990,606 A 2/1935 Junkers
2,974,628 A 3/1961 Erlbacher
3,519,227 A 7/1970 Brooks
4,363,630 A 12/1982 Di Vigano
4,710,142 A * 12/1987 Lovell ..... 440/83
5,443,230 A 8/1995 Lord et al.

* cited by examiner

*Primary Examiner*—Stephen Avila
(74) *Attorney, Agent, or Firm*—Malin Haley DiMaggio Bowen & Lhota, P.A.

(57) ABSTRACT

A support for a marine motor propeller shaft comprising a single leg having an upper section attached to the hull of a boat and a lower section supporting a propeller shaft. The leg has an angled helical twist near the upper section such that the propeller support is angled away from the centerline of the hull and faces the flow vector of inflowing water to the propeller. The angle of the helical twist is determined by analyzing the flow dynamics of water entering the propeller to determine peak fluid flow.

6 Claims, 9 Drawing Sheets

HELICAL MARINE STRUT

BACKGROUND OF THE INVENTION

1. Field of the Invention

The present invention relates to improvements in marine construction and is more specifically concerned with a curved strut for a propeller shaft and propeller designed to take advantage of strut wake, direct flow and increase propeller efficiency and reduce premature wear on the propeller shaft.

2. Description of Related Art

The performance of a ship's propeller is significantly influenced by the wake created by the movement of the ship's hull through the water. It is a consistent goal in the marine industry to improve propeller efficiency in marine vessels. This increases speed and often reduces wear. Further, with increased efficiency, a user may reduce consumption of gasoline. Struts provide stability to propeller shafts. Ship's hulls can have helically shaped channels which create a tangential direction of flow of water into the propeller.

A strut is a bracket outside the hull of a boat or ship. The strut supports the propeller shaft of a marine propeller attached to the shaft and drive system. Struts, at their junction with a marine bearing, are located at a slight angle to the axis of the propeller and vessel in order to minimize resistance and maximize efficiency of the propeller, which leaves the trailing edge of the propeller wheel race in a twisting motion similar to a helix. Certain designs relate to struts that are twisted along their longitudinal axis so that where they are connected to the bottom of the hull they are substantially in line with the axis of the vessel. At this juncture, the effect of the helical swirl from the propeller wheel race is thought to be minimal.

Several forces influence the flow pattern of water into a marine motor propeller. A determination of such flow patterns can be accomplished by analyzing flow dynamics once the water enters the propeller. By determining the flow vector, the strut can be angled such that fluid inflow is maximized. Doing so will reduce friction and resistance by the strut.

The Magnus effect is rotational flow of water around the propeller shaft while the propeller is spinning. Such Magnus effect pulls water into the strut at an angle relative to the speed of the boat and the rotational speed of the shaft. The angle at which the propeller shaft runs to the bottom of the boat is called the "shaft angle". The angle at which the boat runs to the water is called the "running angle". The Magnus effect and the void created aft of the shaft by the shaft angle and running angle accentuates the flow pattern and increases the angle required at the upper section of the strut leg.

Ship rudders are mounted in the stern of a ship and behind the propeller. Thus, rudders are affected by an accelerated and swirling inflow, which is also induced by the helical hull design and the propeller. Such swirled flow increases the angle at which the rudder is affected. This may cause cavitation zones which lead to erosion of the rudder surface. In addition, rudders may cause reduction in propeller performance.

Interaction between the propeller and the rudder creates an increase in turbulence and a drop in efficiency. Most rudders in the marine industry utilize symmetrical profiles having increasing thickness with a view to reduction of hydrodynamic load. An increase in performance of the ship may be achieved by aligning the rudder profiles with the direction of incident flow. However, a more practical solution is to align each rudder profile with the direction of average flow during propeller rotation.

An increase in a ship's propulsive efficiency can be created by using a profiled rudder. The profiled rudder utilizes the rotational energy created by the slipstream flow produced by the propeller. Every propeller creates vortices. Vortices are regions of low pressure, oftentimes filled with tubes of cavitation. Spirals can be formed behind the propeller. The rudder intersects the spirals to cause cavitation on the rudder.

The existing strut designs typically include a single vertical leg extending from the bottom of the hull of a boat to the propeller shaft. The typical leg is foil shaped and sits parallel to the centerline of the hull. The leg obstructs the direct flow of water towards the propellers. Additionally, typical strut designs rake aft. Typically, the strut has a barrel that houses a main bearing. Cavitation is often a result of the strut not being inline with the flow of water into the propeller. Cavitation is the formation of gas-filled cavities within liquids by mechanical forces. Cavitation can cause the paint on the bottom of the hull to wear off. This is caused by the collapse of cavitation bubbles on the surface of the metal or liquid.

Several attempts to solve such problems have been presented where the inflow of water is turned with fixed or adjustable fins or vanes to cause the water flow to counter the rotation of the propeller. Thus, this creates increased efficiency because output swirl is reduced from the propeller. The instant inventions involve a different concept and approach, by desiring to match and utilize the rotational inflow instead of creating counteracting forces.

U.S. Pat. No. 2,974,628 issued to Erlbacher on Mar. 14, 1961 entitled TWISTED STRUT CONSTRUCTION FOR MARINE BEARING WITH FORWARDLY MOUNTED PROPELLER discloses a rearwardly mounted V-shaped strut supported from the hull with the apex of the V being formed on the propeller bearing. The two separate longitudinal portions of the V-shape are mounted to the hull. The struts, at the apex, are located at a slight angle to the axis of the propeller and the boat. The two struts are twisted along their longitudinal axis and are further streamlined in cross section so as to minimize water flow. This specific twisted strut construction used to mount the propeller to the underside of a hull. This is a custom designed strut and brace assembly, in which the struts are actually placed behind the propeller blades for the specific purpose of eliminating the obstructions offered to the flow of water encountering the propeller. The struts are actually mechanically connected to the propeller bearing, and therefore the struts are behind the forwardly mounted propeller. The '628 patent teaches that the twisted relationship of the struts behind the operation of the propeller blades creates a minimum of resistance to the wheel race and to the movement of the undisturbed water past the vessel. It was also a goal of this design to provide a forwardly mounted propeller "without any strut or bearing structure in front of it", with a supposed achieved efficiency in operation.

U.S. Pat. No. 1,990,606 issued to Junkers on Feb. 12, 1935 entitled SHAFTING FOR POWER TRANSMISSION teaches shafting structures for power transmission to balance forces in relation to airplanes.

U.S. Pat. No. 3,519,227 issued to Brooks on Jul. 7, 1970 entitled MOUNTING MEANS FOR AN AIRCRAFT ENGINE teaches an engine containing pod mounted from an aircraft structure and at least one fence extending from the pod or the aircraft structure adjacent the pod. The fences are slightly curved.

U.S. Pat. No. 5,443,230 issued to Lord et al. on Aug. 22, 1995 entitled AIRCRAFT WING/NACELLE COMBINATION teaches a wing including a pylon with a cambered airfoil which extends toward the fuselage over at least a portion of the pylon to divert a portion of the airflow away from the channel region. The pylon has curvature in both the vertical and horizontal directions. The '230 teaches of a particular pylon construction for the cambered airfoil, which mounts an aircraft engine to the wing of a plane. The pylon is a three dimensional airfoil shape, which has curvature in both the vertical and horizontal directions, in varying degree, in order to increase aerodynamic performance, reduce drag and shockwave effects, and to control airflow entering select channel regions and redirecting the flow outwardly.

U.S. Pat. No. 4,363,630 issued to Di Vigano on Dec. 14, 1982 entitled SHIP'S HULL WITH A HELICAL CHANNEL AHEAD OF EACH PROPELLER AND METHOD OF ESTABLISHING THE SHAPE OF THE SAME teaches a hull design having a partially helicoidal or cochleaform channel leading towards a propeller. The helical channel leads water to the propeller. a ship's hull, which incorporates a helical channel formed in the hull in front of a propeller or multiple propellers. The '630 patent discloses test models, and related hydrodynamic and theoretical analysis related to creating a "dissymmetry" to the hull design. The helical channel is actually incorporated into the ship's hull, and meant to enhance the tangential and axial vector components of the flow of water through the channel incident to the hull. The essence of the patent seeks to impart to the water a macroscopic vortex flow, in order to achieve the desired results.

The prior art fails, however, to provide a particular helical or twisted strut and related structure which matches the rotational inflow to the propeller as opposed to countering it, thus improving the advance velocity into the propeller disk resulting in higher efficiencies.

SUMMARY OF THE INVENTION

In marine propulsion systems utilizing propellers there is a fixed support other than the shaft hull penetration forward of the propeller. This support, comprised of one or more components is commonly referred to as a strut(s). The strut maintains the propeller's position below the hull, and minimizes propeller shaft deflections. The strut must be located in close proximity to the propeller to appropriately control the large torsional loads induced by the propeller. However, this short distance introduces an undesirable wake into the propeller plane inlet, which negatively effects propeller efficiency (also including speed), vibration, and established cavitation fields.

Wake shed from any underwater appendage has been studied by Applicants in attempt to provide a smooth flow field to the inlet of the propeller plane. Conventional strut designs do not account for wake fraction other than minimizing section thickness and edge shape in an attempt to reduce wake. The invention at hand utilizes existing flow flied relationships to design strut section shape in order to enhance propeller efficiency by utilizing the already existing strut wake. Once these relationships are established the strut's wake can be shaped and directed to feed the propeller at an optimum angle along any radius of the propeller blade. The direction, velocity, and volume of flow directed depends on vessel speed, propeller induced pressure differential, propeller design specifications, rpm, depth, hull design, and other flow impingements upstream of the strut. Relating these variables will suggest the desired propeller inlet flow characteristics, which in turn can be used to develop strut section shapes. The helical strut designs of the instant inventions have the advantages of utilizing standard bearings and installation due similarities to conventional strut palm and barrel.

The instant inventions include a marine strut for a marine motor propeller comprising a single leg having an upper section attached to the hull of a boat and a lower section. The leg has an angled generally helical twist near the upper section such that the marine strut is angled towards the flow vector of inflowing water to the propeller. The angle of the helical twist is determined by analyzing the flow dynamics of water entering the propeller. A series of factors are utilized with a CFD analysis to determine the most efficient angle at which the top of the leg must be twisted.

It is an object of the present invention to produce higher speeds of a boat through better and more efficient fluid inflow to the propeller.

A further object of the present invention is to provide less blade rate vibrations on the propeller.

Yet a further object of the present invention is to reduce cavitation on the propeller propeller blades and rudder blades.

Yet a further object of the present invention is to maximize the geometric design of a vessel's strut to control water flow and hydrodynamic forces and maximize the performance of the propeller.

In accordance with these and other objects which will become apparent hereinafter, the instant invention will now be described with particular reference to the accompanying drawings.

DETAILED DESCRIPTION

The present invention is a support for a marine motor propeller shaft comprising a single leg having an upper section attached to the hull of a boat and a lower section supporting a propeller shaft. The leg has an angled helical twist near the upper section such that the propeller support is angled away from the centerline of the hull and faces the flow vector of inflowing water to the propeller. The angle of the helical twist is determined by analyzing the flow dynamics of water entering the propeller to determine peak fluid flow.

Figure 1:
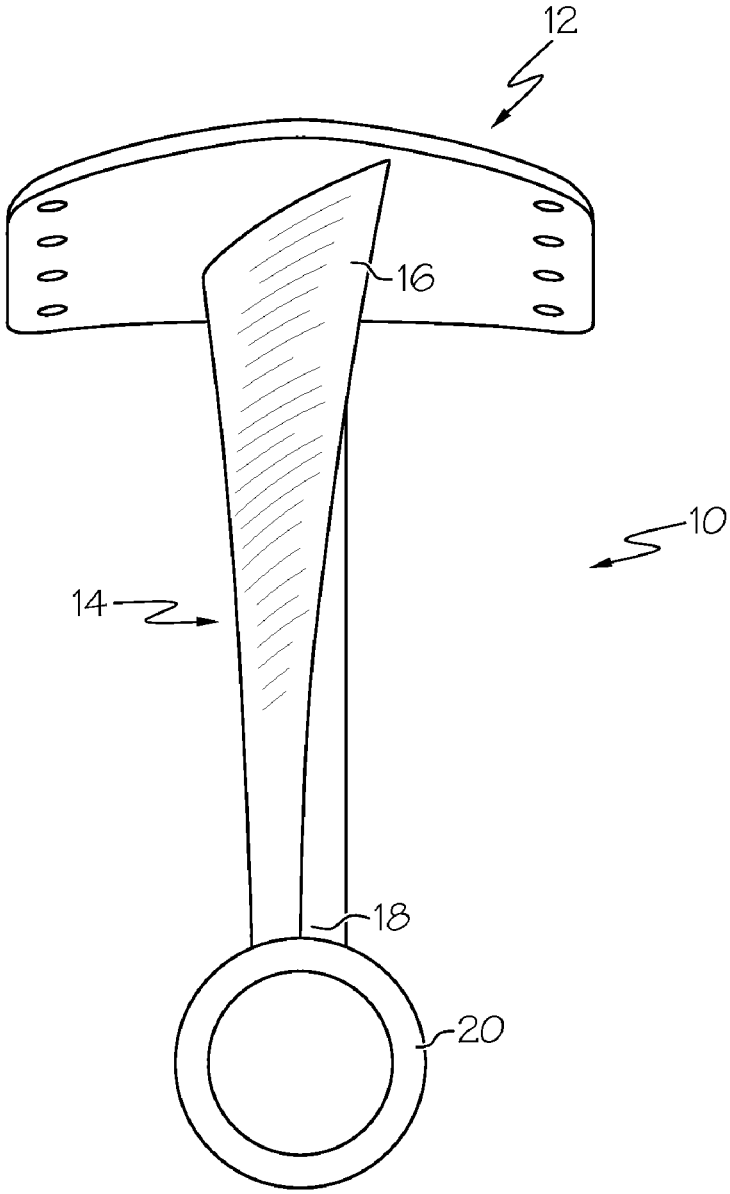
FIG. 1 shows an aft view of the helical strut exemplifying the curved leg.

With reference to FIG. 1, the support 10 is shown detached from the hull of a ship. Such support 10 is more commonly referred to as a strut. Such strut 10 is often mounted at the stern of the hull and is mounted in front of the ship rudder. Such strut 10 is commonly used to support a ship propeller rod, which turns the propeller. As shown, the support 10 has a mounting plate 12 which is mounted to the hull of a ship. Below the mounting plate 12 is the leg 14 of the strut 10. The leg 14 has an upper section 16 and a lower section 18. As shown, the present invention contemplates that the upper section 16 will be helically shaped to match the inflow of water to the propeller. Due to the flow vectors created by the hull, the water does not enter the propeller at a straight angle. Thus, to increase the performance and efficiency of the propeller, the upper section 16 is turned. This will also help reduce the potential for cavitation. At the base of the lower section 18 is the ring 20 which is used to support the propeller shaft or rod. This ring 20 has a cylindrical shape. Thus, the propeller rod is inserted through the ring 20.

Figure 2:
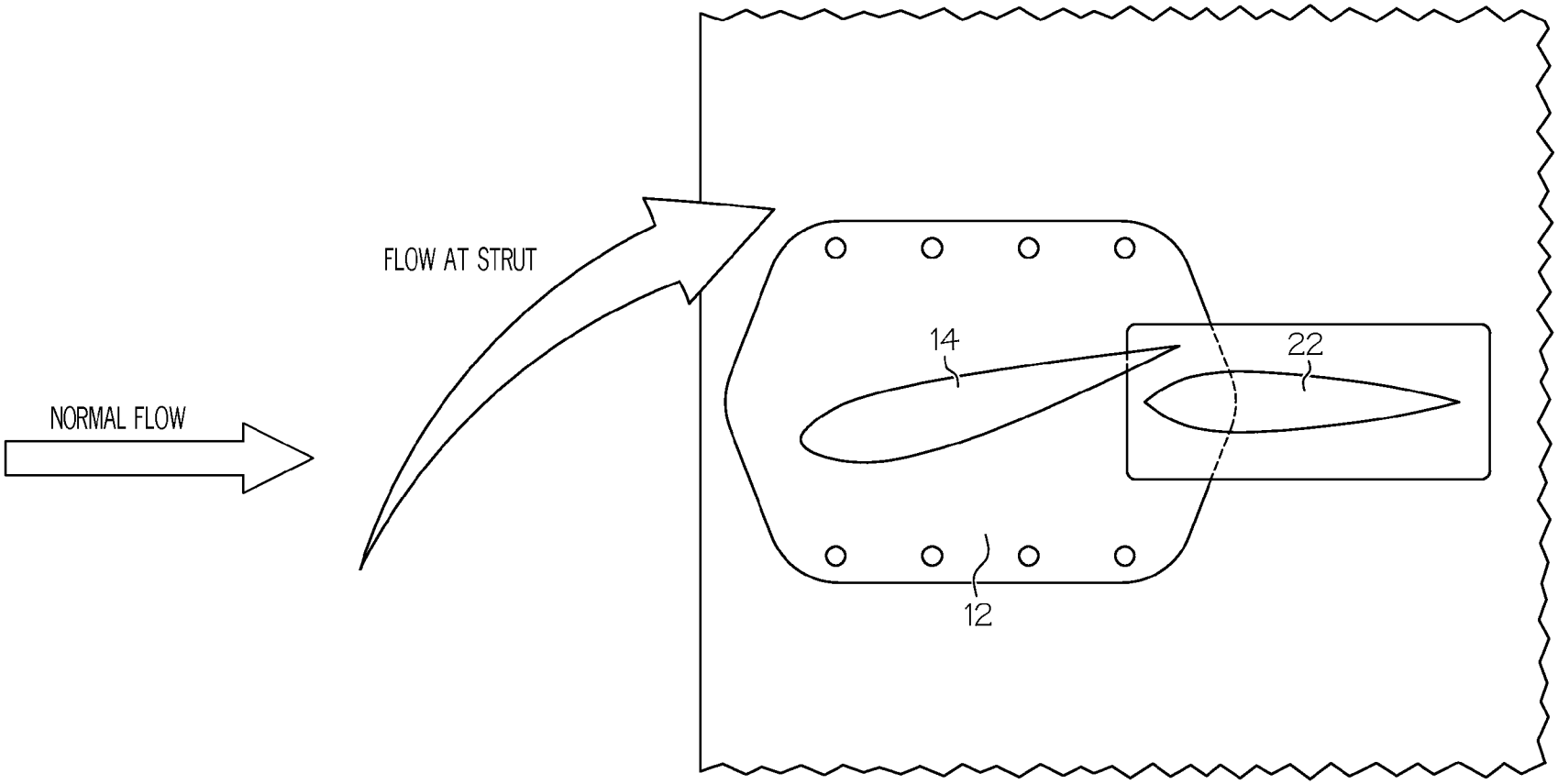
FIG. 2 shows a plan view of the helical strut and rudder and the hydrodynamic flow which affects them.

With reference to FIG. 2, a plan view of the helical strut leg 14 and rudder 22 and the hydrodynamic flow which affects them is shown. As shown, the strut 10 is mounted in front of the rudder 22. Also shown, the leg 14 is not mounted in the same direction as the normal flow of water. The leg 14 is mounted in a helical direction and is angled in the same direction as the actual flow at the strut. By matching the actual flow at the strut, the performance of the propeller is increased.

Figure 3:
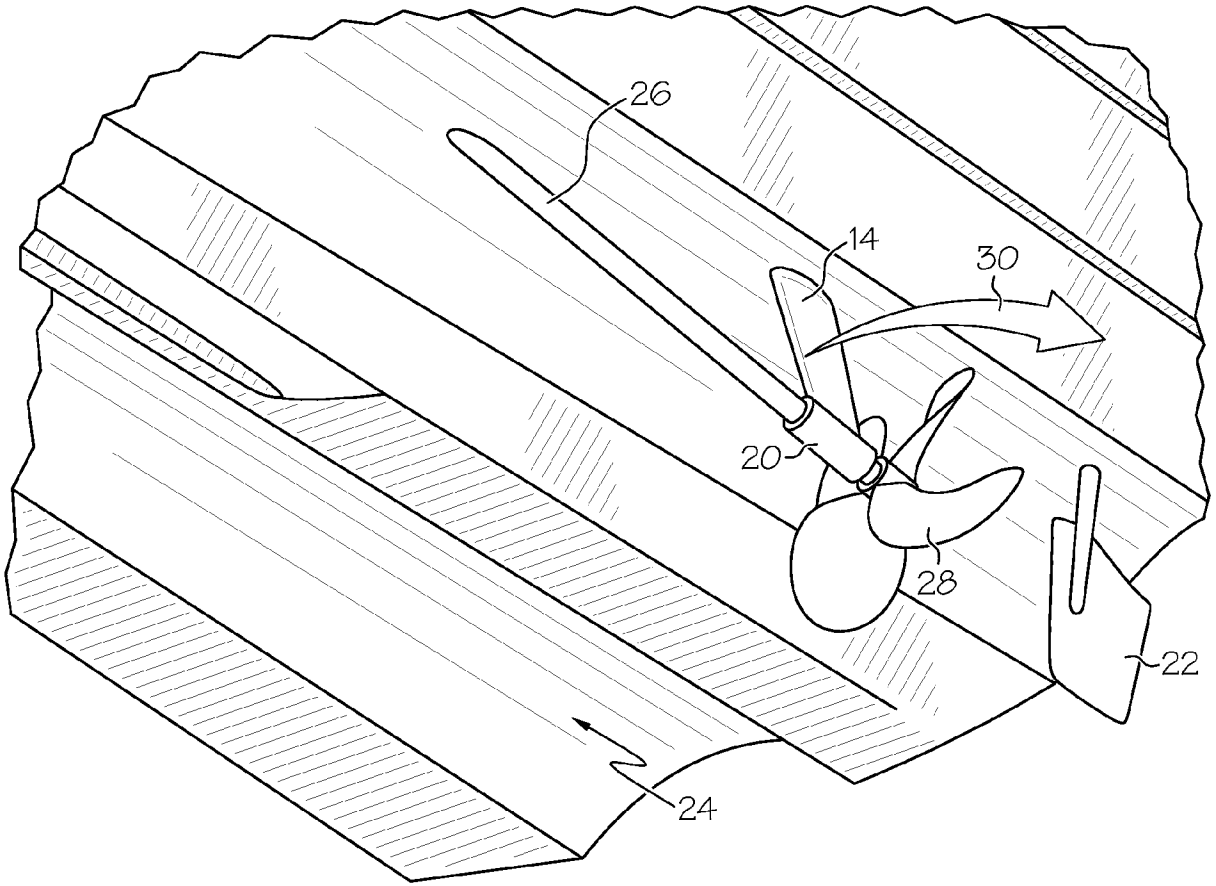
FIG. 3 shows a perspective view of the hull of a ship showing the strut, the propeller, the rudder, the helical channels of the hull, and the hydrodynamic flow created by the propeller and strut.
Figure 5:
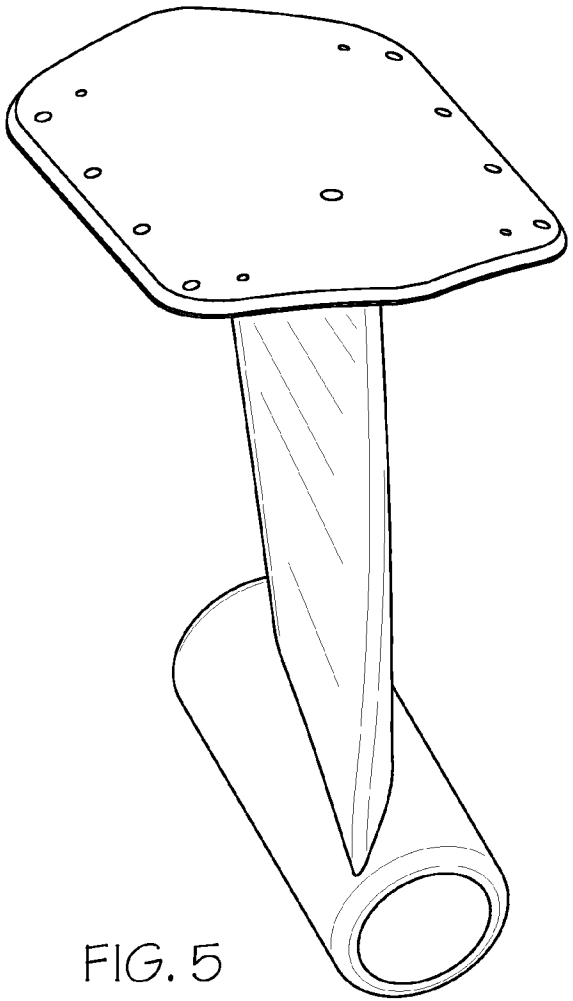
FIG. 5 illustrates a perspective view of the helical strut of the instant invention.
Figure 4:
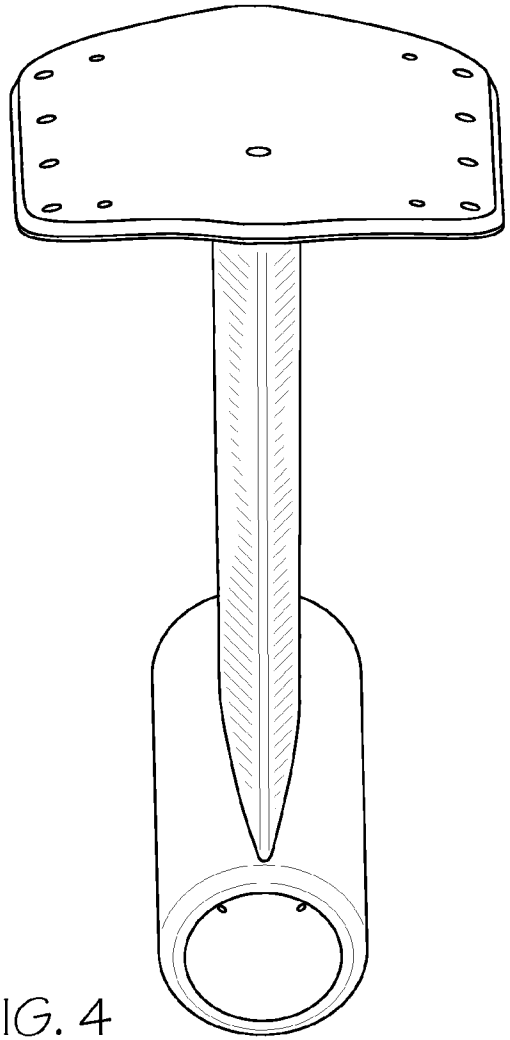
FIG. 4 illustrates a perspective view of a conventional strut.
Figure 7:
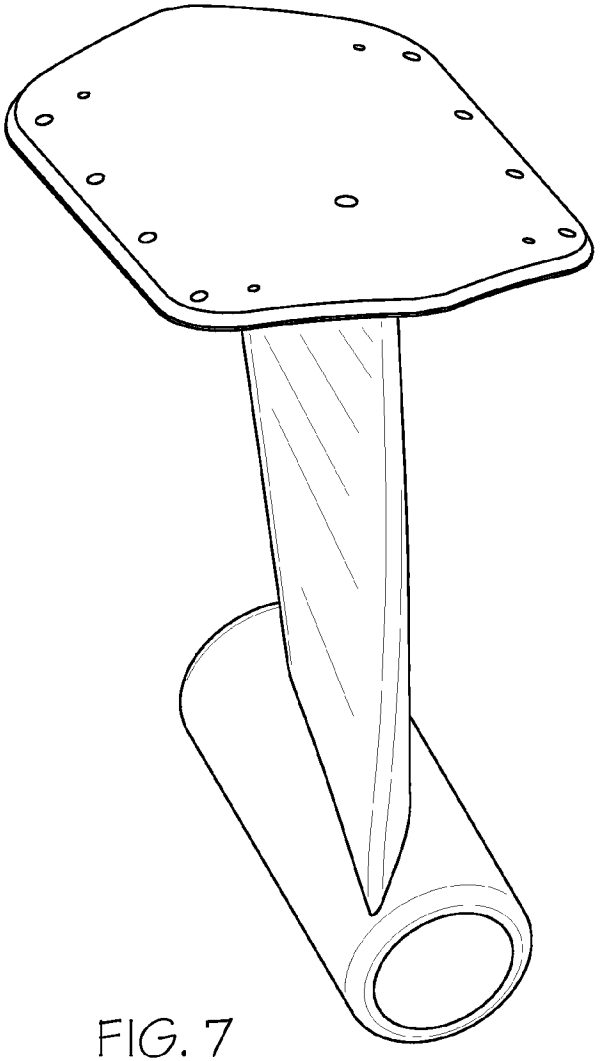
FIG. 7 is an alternative perspective view of an embodiment of the helical strut.
Figure 6:
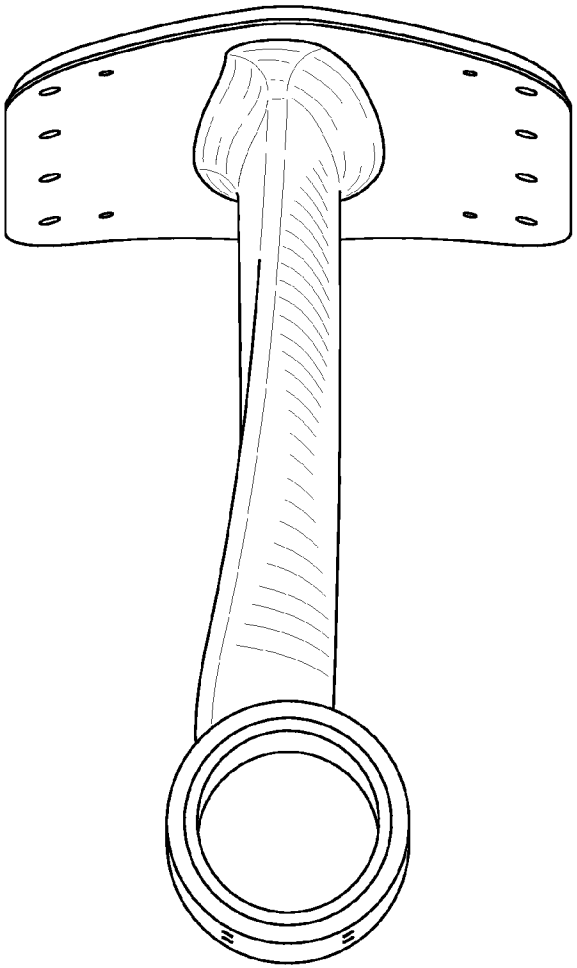
FIG. 6 is a perspective plan view of an embodiment of the helical strut.
Figure 9:
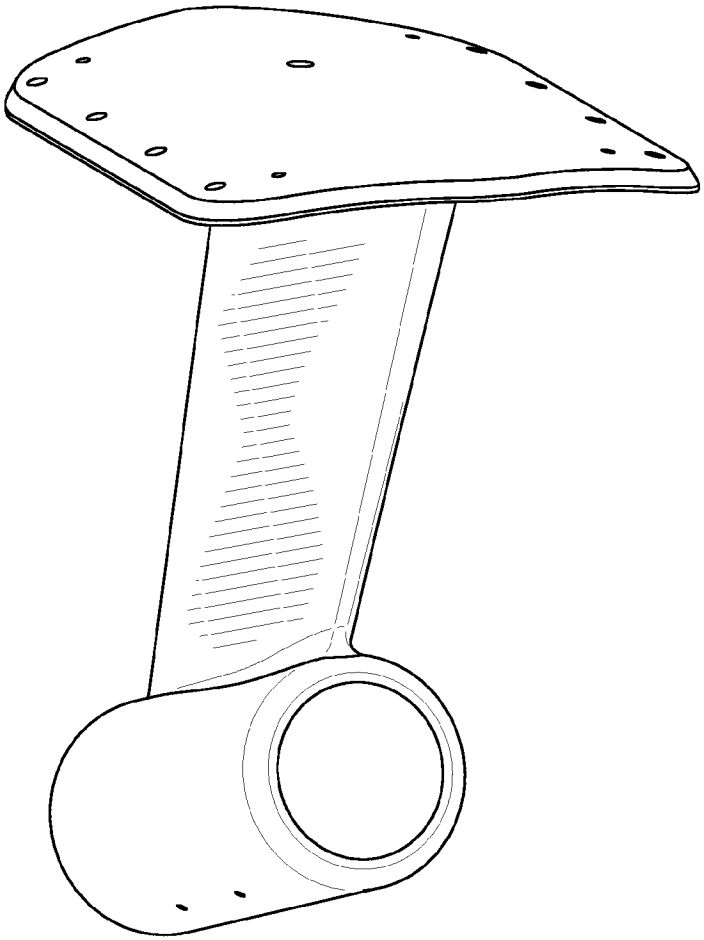
FIG. 9 is an alternative perspective plan view of an embodiment of the helical strut.
Figure 8:
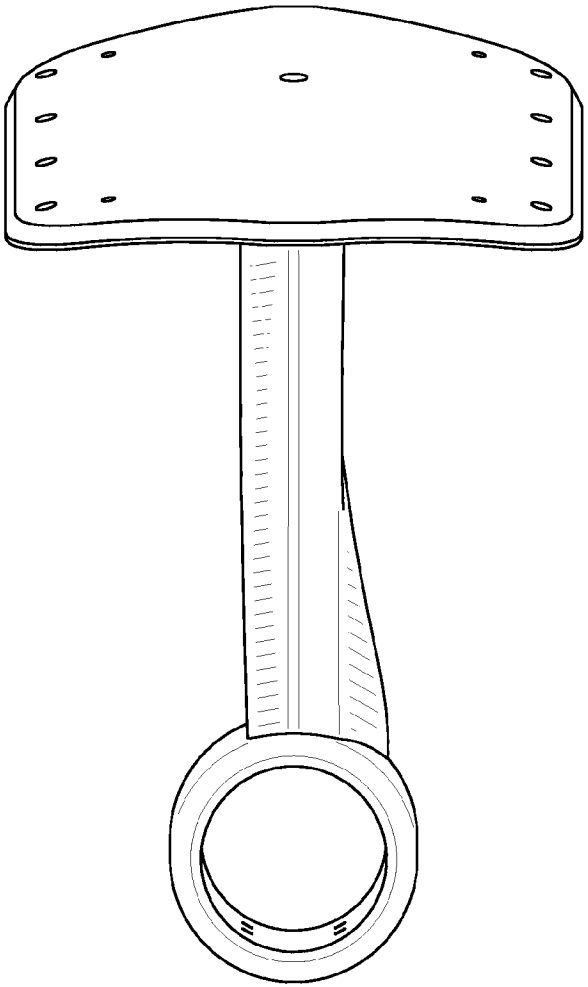
FIG. 8 is an alternative perspective plan view of an embodiment of the helical strut.
Figure 10A:
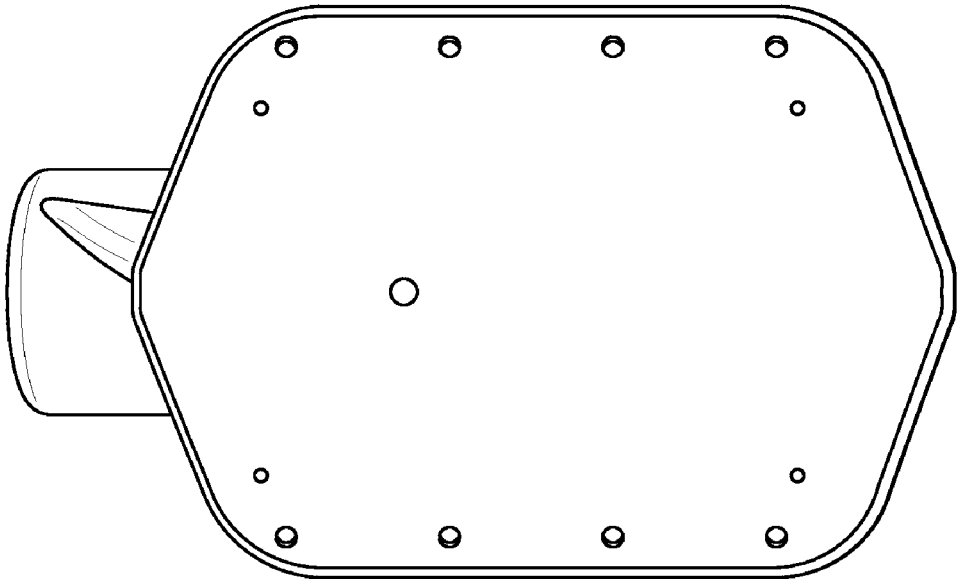
FIG. 10A through FIG. 10E are perspective, front plan, side plan, top plan and cross-sectional views of the instant inventions.
Figure 10B:
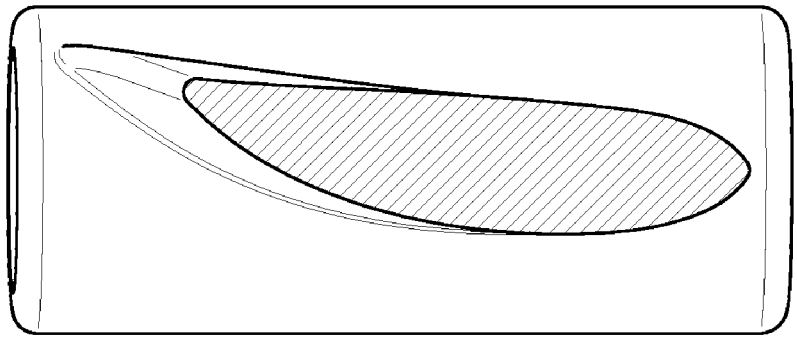
Figure 10D:
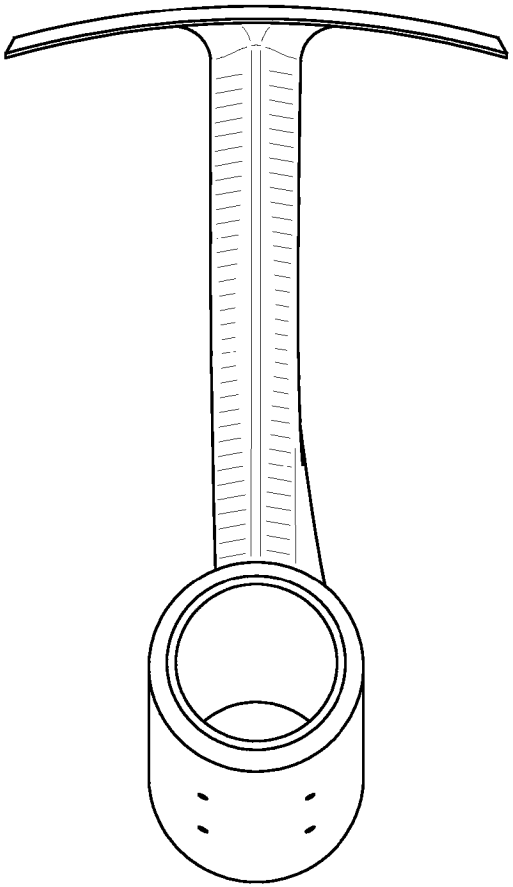
Figure 10C:
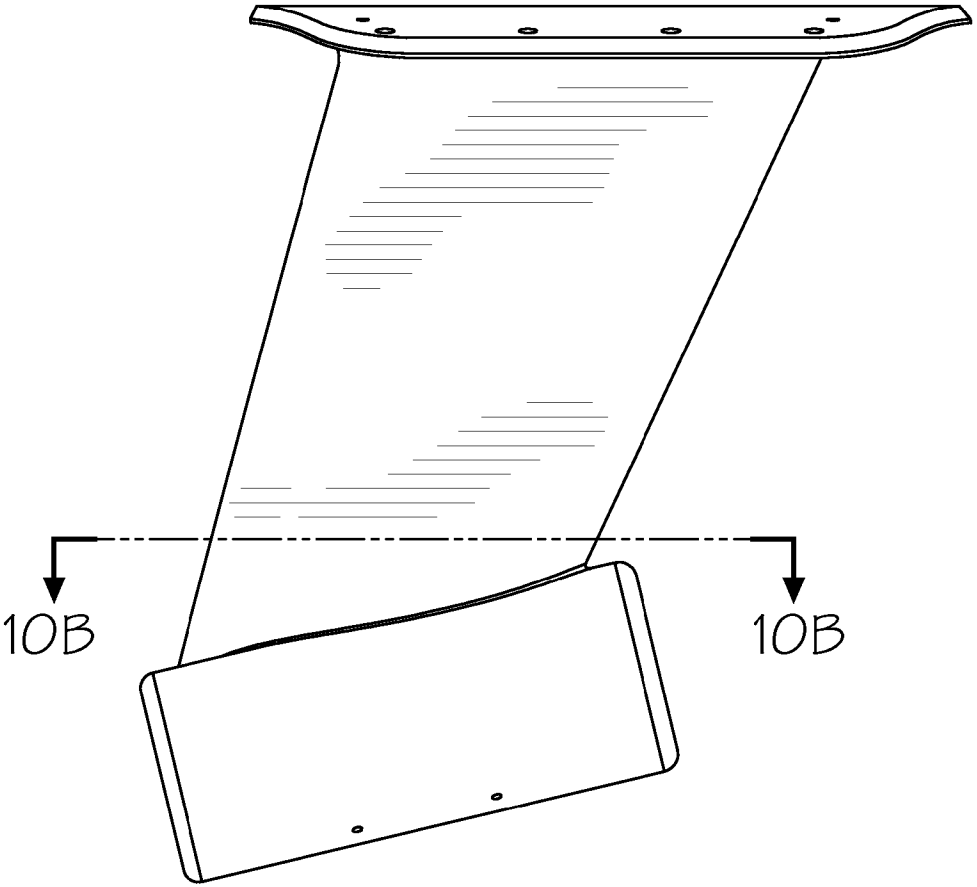
Figure 10E:
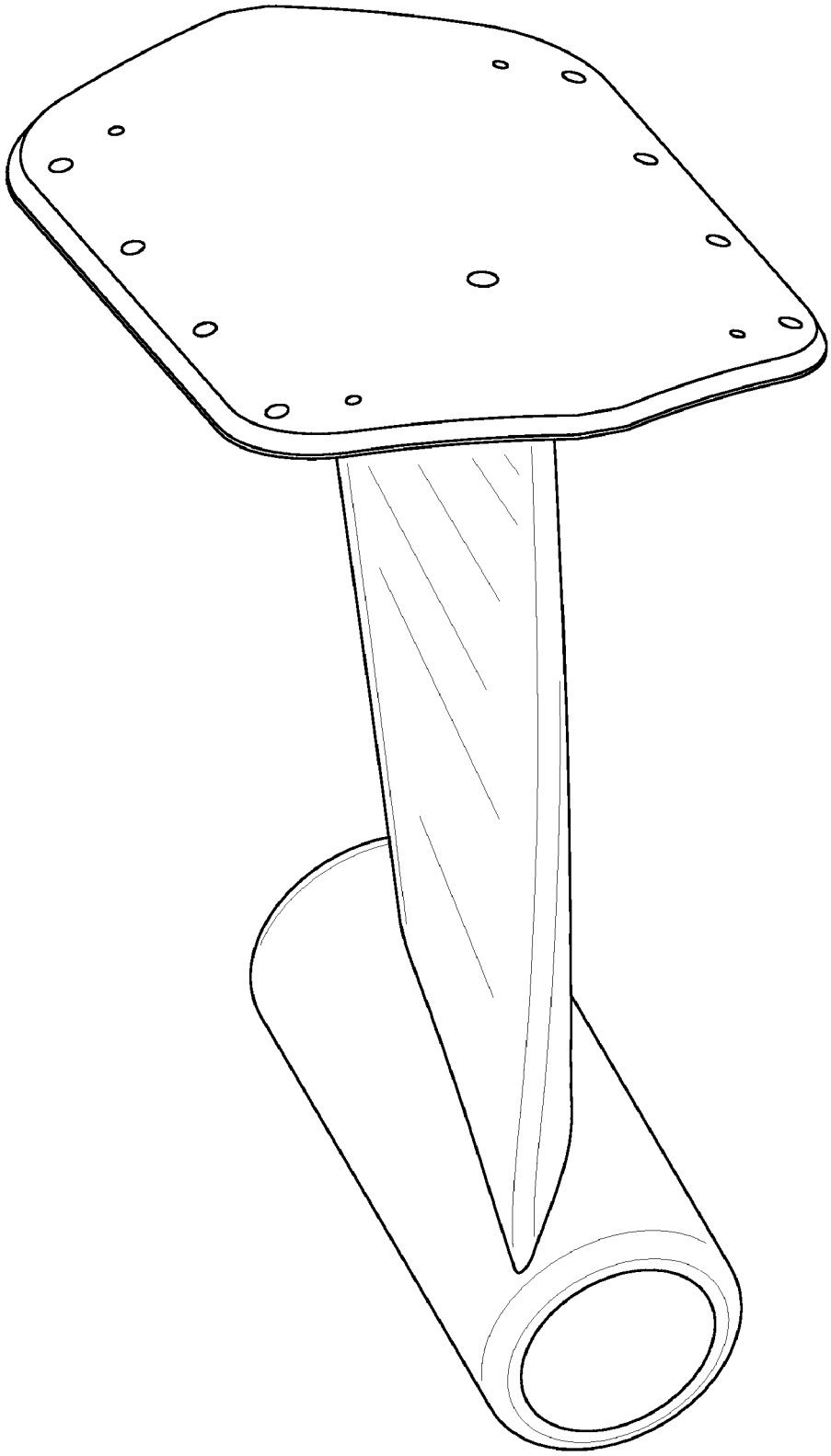

With reference to FIG. 3, the underside of a ship hull 24 is shown. As shown, the ship hull 24 has helical channels. The strut 10 is mounted to the hull in front of the rudder 22. As shown, the propeller shaft 26 extends rearwardly from a motor and is supported by the ring 20 at the base of the strut 14. The propeller blades 28 extend out of the ring 20 on the aft side. As shown, the flow of water 30 moves outwardly away from the propeller blades 28 and rudder 22. This effect is due to the helical twist at the upper section 16 of the leg 14. This effect will increase the propeller performance and help reduce cavitation on the rudder 22.

FIG. 4 through FIG. 10 are additional perspective views, top plan views, rear plan views, side plan views, perspective views and cross-sectional views illustrating the structure of the instant inventions, helical and twisted struts.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A support for a marine motor propeller shaft, the support being utilized in a marine vessel having an inboard propulsion drive system, the drive system including a propeller shaft extending through the vessel hull, a propeller mounted at the end of the propeller shaft, and a rudder mounted aft of the propeller, comprising:

a single leg having an upper section attached to the hull of a boat and a lower section supporting a propeller shaft;

the leg being attached to the hull forward of the propeller, the leg lower section supporting the propeller shaft also being forward of the propeller; and the leg having an angled helical twist near the upper section such that the propeller support is angled with respect to the centerline of the hull and creates a gradient flow vector of inflowing water to the propeller;

said helical twist diminishing from said leg upper section towards said leg lower section, said leg lower section being generally straight.

2. The propeller support described in claim 1, wherein the angle of the helical twist is determined by analyzing the flow dynamics of water entering the propeller to determine peak fluid flow.

3. A support for a marine motor propeller shaft, the support being utilized in a marine vessel having an inboard propulsion drive system, the drive system including a propeller shaft extending through the vessel hull, a propeller mounted at the end of the propeller shaft, and a rudder mounted aft of the propeller, comprising:

a single leg having an upper section attached to the hull of a boat and a lower section supporting a propeller shaft;

the leg being attached to the hull forward of the propeller, the leg lower section supporting the propeller shaft also being forward of the propeller; and the leg having an angled helical twist near the upper section such that the propeller support is angled away from the centerline of the hull and creates a gradient flow vector of inflowing water to the propeller; said helical twist diminishing from said leg upper section towards said leg lower section, said leg lower section being generally straight; and wherein the angle of the helical twist is determined by analyzing the flow dynamics of water entering the propeller to determine peak fluid flow.

4. A support for a marine motor propeller shaft, the support being utilized in a marine vessel having an inboard propulsion drive system, the drive system including a propeller shaft extending through the vessel hull, a propeller mounted at the end of the propeller shaft, and a rudder mounted aft of the propeller, comprising:

a single leg having an upper section attached to the hull of a boat and a lower section supporting a propeller shaft;

the leg being attached to the hull forward of the propeller, the leg lower section supporting the propeller shaft also being forward of the propeller; and the leg having an angled helical twist near the upper section such that the propeller support is angled towards the centerline of the hull and creates a gradient flow vector of inflowing water to the propeller; said helical twist diminishing from said leg upper section towards said leg lower section, said leg lower section being generally straight; and wherein the angle of the helical twist is determined by analyzing the flow dynamics of water entering the propeller to determine peak fluid flow.

5. A support for a marine motor propeller shaft, the support being utilized in a marine vessel having an inboard propulsion drive system, the drive system including a propeller shaft extending through the vessel hull, a propeller mounted at the end of the propeller shaft, and a rudder mounted aft of the propeller, comprising:

a single leg having an upper section attached to the hull of a boat and a lower section supporting a propeller shaft;

the leg being attached to the hull forward of the propeller, the leg lower section supporting the propeller shaft also being forward of the propeller; and the leg having an angled helical twist near the lower section such that the propeller support is angled with respect to the centerline of the hull and creates a gradient flow vector of inflowing water to the propeller;

said helical twist increasing from said leg upper section towards said leg lower section, said leg upper section being generally straight.

6. The propeller support described in claim 5, wherein the angle of the helical twist is determined by analyzing the flow dynamics of water entering the propeller to determine peak fluid flow.

* * * * *